US007510368B2

(12) United States Patent
Stahle

(10) Patent No.: US 7,510,368 B2
(45) Date of Patent: Mar. 31, 2009

(54) SCREW-CENTRIFUGAL PUMP

(75) Inventor: Martin Stahle, Neunkirch (CH)

(73) Assignee: Frideco AG, Neunkirch (CH)

( * ) Notice: Subject to any disclaimer, the term of this patent is extended or adjusted under 35 U.S.C. 154(b) by 113 days.

(21) Appl. No.: 10/588,736

(22) PCT Filed: Nov. 2, 2004

(86) PCT No.: PCT/CH2004/000664

§ 371 (c)(1),
(2), (4) Date: Aug. 8, 2006

(87) PCT Pub. No.: WO2005/098237

PCT Pub. Date: Oct. 20, 2005

(65) Prior Publication Data

US 2007/0172345 A1 Jul. 26, 2007

(30) Foreign Application Priority Data

Apr. 7, 2004 (EP) ..... 04405214

(51) Int. Cl.
*F03B 3/12* (2006.01)

(52) U.S. Cl. ..... 415/121.1; 415/208.2

(58) Field of Classification Search ..... 415/71, 415/72, 74, 76, 121.1, 191, 208.2
See application file for complete search history.

(56) References Cited

U.S. PATENT DOCUMENTS 3,340,812 A 9/1967 Schlesiger
4,778,336 A 10/1988 Husain

FOREIGN PATENT DOCUMENTS

| | | |
|---|---|---|
| CH | 394 814 | 6/1965 |
| EP | 0 233 859 | 8/1987 |
| FR | 2048605 | 3/1971 |
| FR | 2460404 | 2/1981 |
| SU | 1132062 | 12/1984 |
| SU | 1286817 | 1/1987 |
| SU | 1677371 | 9/1991 |

OTHER PUBLICATIONS

International Search Report from Application No. PCT/CH2004/000664, dated Dec. 21, 2004.
Russian Decision on Grant of Application No. 2006139075 Mailed on Nov. 6, 2008.

*Primary Examiner*—Edward Look
*Assistant Examiner*—Dwayne J White
(74) *Attorney, Agent, or Firm*—Pearl Cohen Zedek Latzer, LLP

(57) ABSTRACT

A screw-centrifugal pump (1) comprises a pump housing (3) having an inlet opening (3*c*) and also an impeller (2) arranged within the pump housing (3) and rotatable about an axis of rotation (2*d*) in a direction of rotation (4*a*). The impeller (2) has a spirally extending blade entry edge (2*a*) and a guide vane (5) projects into the interior space of the impeller (2) and is disposed in the region of the inlet opening (3*c*). A method of conveying a liquid permeated with solid additions using such a pump is also described and claimed.

10 Claims, 2 Drawing Sheets

SCREW-CENTRIFUGAL PUMP

PRIOR APPLICATION DATA

The present application is a national phase application of International Application PCT/CH2004/000664, entitled "SCREW-CENTRIFUGAL PUMP" filed on Nov. 2, 2004, which in turn claims priority from European Patent Application EP 04405214.0, filed on Apr 7, 2004, all of which are incorporated by reference in their entirety.

FIELD OF THE INVENTION

The invention relates to a screw-centrifugal pump. The invention further relates to a method for the conveying of a medium with a screw-centrifugal pump.

BACKROUND OF THE INVENTION

A screw-centrifugal pump also termed a screw pump is known from the document CH 394814. A rotary pump of this kind includes a single helically extending blade which is rotatably disposed in a pump housing. This pump is in particular suitable for conveying liquids permeated with solid additions, in particular for conveying waste water with long fibrous components.

The possibility of pumping liquid with a high concentration of fibrous solid materials which tend for example to tress formation is restricted. This can lead to deposits of solid components in the pumping path or to a blockage caused thereby right up to pump stoppage.

SUMMARY

The invention is based on the object of providing a screw-centrifugal pump which has more advantageous characteristics in conveying liquids permeated with solid additions.

This object is satisfied with a screw-centrifugal pump having the features of claim 1. The subordinate claims 2 to 8 relate to further advantageous embodiments. The object is further satisfied by a method having the features of claim 9.

The object is in particular satisfied with a screw-centrifugal pump comprising a pump housing having an inlet opening and also an impeller arranged within the pump housing and rotatable about an axis of rotation in a direction of rotation, the impeller having a spirally extending blade entry vein edge, with a guide vane projecting into the interior space of the impeller being disposed in the region of the inlet opening.

In a particular advantageous design the guide vane of the screw-centrifugal pump has a guide vane edge which, in the direction of rotation of the impeller, increasingly projects in the direction of flow into the interior space towards the centre of the impeller. The screw-centrifugal pump in accordance with the invention is in particular advantageous when pumping high concentrations of fibrous materials which tend to tress formation. If the solid concentration of the floated in, fibrous, solid material continuously increases then this leads to ball formation in the suction line and to an increased friction in the impeller passage. If, in this connection, a certain limiting value is achieved, then the hydraulic forces alone are no longer able to pump the material which has the consequence that the screw-centrifugal pump clogs up and blocks. The screw-centrifugal pump of the invention prevents this blockage in that the spiral blade entry edge of the start of the screw section of the impeller rotates relative to the fixedly arranged projecting guide vane, with the blade entry edge and the guide vane cooperating in such a way that the solid masses located between them are engaged by the rotating blade entry edge and loosened up and/or pressed in the flow direction along the blade entry edge. Through this cooperation of the guide vane and the screw-centrifugal impeller a mechanical force acting substantially in the pump direction is exerted on the conveying medium, in addition to the hydraulic forces, which prevents an accumulation of solid components in the pump path.

In a further advantageous embodiment, the guide vane edge forms a fixed three-dimensional curve and the blade entry edge forms a rotatable three-dimensional curve as a result of the rotatable screw-centrifugal impeller, with these two three-dimensional curves preferably being designed so that they are matched to one another and extend in such a way that they move past one another on rotation of the impeller with a small mutual spacing, or mutually contacting one another. The solid materials located between the two three-dimensional curves are thereby moved mechanically in the direction of extent of the three-dimensional curves and are thereby substantially moved in the flow direction and loosened up or pressed in the flow direction.

In a further advantageous embodiment the guide vane edge and/or the blade entry edge have a cutting edge, at least in part, so that the solid materials between the mutually moving three-dimensional curves can also be additionally mechanically weakened or comminuted. With solid materials which tend to tress formation this brings about a weakening, loosening up, comminution or cutting of the tresses or fibres, which prevents an accumulation of the tresses in the pump path and thus ensures a continuous reliable operation of the screw-centrifugal pump without interruption.

The mutual shearing, parting or clamping action of the two three-dimensional curves also enables, independently of the design of the guide vane edge and/or of the blade entry edge, a cutting through, comminution or weakening of fibrous solid materials such as paper, cords, wood or solid materials such as plastic, rubber, metal or glass.

BRIEF DESCRIPTION OF THE DRAWINGS

The invention will be described in more detail in the following with reference to embodiments. There are shown.

DETAILED DESCRIPTION OF THE INVENTION

Figure 1:
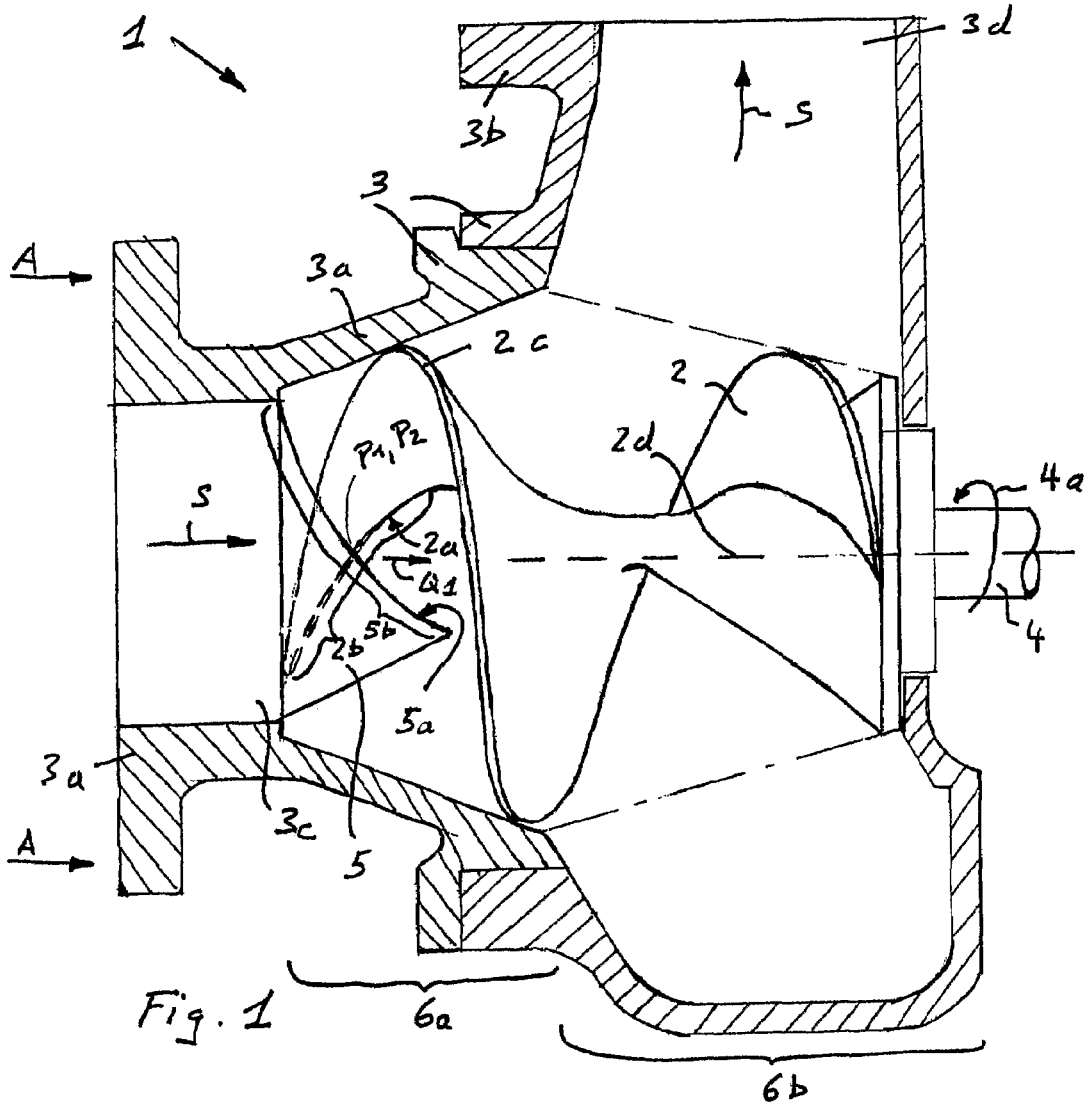
FIG. 1 an axial section through a screw-centrifugal pump.

The screw-centrifugal pump 1 of FIG. 1 includes a screw-centrifugal impeller 2 which is disposed in a pump housing 3 and is rotatable about an axis of rotation 2*d* in a direction of rotation 4*a*. The screw-centrifugal impeller 2 has a spirally extending blade entry edge 2*a* and also an outer contour 2*c*. The screw-centrifugal impeller 2 is fixedly connected to a pump shaft 4. The pump housing 3 includes a conical suction housing part 3*a*, a spiral housing part 3*b*, an inlet opening 3*c* and also an outlet opening 3*d*. A projecting guide vane 5 having a guide vane edge 5*a* is fixedly arranged in the region of the inlet opening 3*c* and is projecting in the inner space of the pump housing 3 and also in the interior space of the screw-centrifugal impeller 2. In the present document the term "interior space of the impeller 2" will be understood to mean the interior space which, when the screw-centrifugal impeller 2 is rotating, is bounded by the outer contour 2*c* so that the guide vane 5 at least partly extends into this interior space and the screw-centrifugal impeller 2 surrounds the guide vane 5 outwardly, as shown in FIG. 1, in the region of the apex of the screw-centrifugal impeller 2 or, at a maximum, within the screw section 6*a*. The screw-centrifugal pump 1 also includes a screw section 6*a* and a centrifugal section 6*b*. The medium pumped by the pump 1 flows in the flow direction S.

Figure 2:
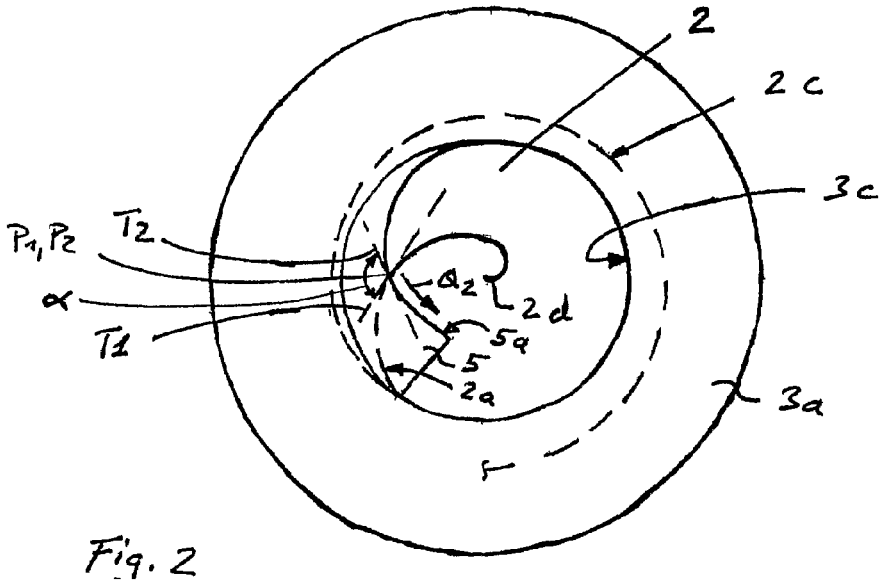
FIG. 2 a front view of the entry opening of the screw-centrifugal pump.

FIG. 2 shows a front view of the inlet opening 3*c* in the direction designated A in FIG. 1, with the impeller 2 and also the guide vane 5 being recognizable in the interior of the pump 1. For the impeller 2 the spirally extending blade entry edge 2*a* is evident which drops off towards the axis of rotation 2*d* and grows axially into the latter. The front-most section of the blade entry edge 2*a* is not directly visible because of the guide vane 5 and has therefore been drawn in broken lines.

In the FIGS. 1 and 2 the guide vane 5 is designed in such a way that the guide vane edge 5*a* projects, in the direction of rotation 4*a*, increasingly in the direction of the axis of rotation 2*d*, both in the radial direction and also in the axial direction into the interior space of the impeller 2. The guide vane edge 5*a* forms a fixed three-dimensional curve whereas the blade entry edge 3*a* forms a three-dimensional curve rotatable about the impeller axis 2*d*. These two three-dimensional curves 2*a*, 5*a* are designed in the illustrated embodiment such that they are mutually matched and extend in such a way that the guide vane edge 5*a* forms a guide vane edge section 5*b* and the blade entry edge 2*a* has a blade edge section 2*b* within which the guide vane edge 5*a* and the blade entry edge 2*a* have a small mutual spacing from one another, in dependence on the respective position of the impeller 2, or mutually touch one another. The small mutual spacing can for example have a value between 0.1 and 30 mm. This position with the smallest possible spacing is illustrated by the point P1 on the blade edge section 2*b* and also by the point P2 on the guide vane edge section 5*b*. As a result of the rotation of the impeller 2 the direction of rotation 4*a* the points P1, P2 move, in the view shown in FIG. 1, essentially in the direction Q1 of the axis of rotation 2*d*, and substantially in the direction Q2 in the view shown in FIG. 2, corresponding to the shape of the guide vane edge 5*a*. In this way a solid material located between the blade edge section 2*b* and the guide vane edge section 5*b* is mechanically conveyed essentially in the direction Q1, i.e. in the flow direction S.

The guide vane 5 can be arranged in the most diverse manner in the pump housing and designed such that the fixed guide vane edge 5*a* and the rotating blade entry edge 2*a* cooperate in such a way that solid materials are mechanically conveyed by the mutual collaboration by the edges 2*a*, 5*a*, in particular in the flow direction S.

As evident from FIG. 2 the blade edge section 2*b* has a tangent T1 at the point P1 and the guide vane edge section 5*b* has a tangent T2 at a point P2, with these two tangents T1, T2 having an intersection angle α when considered from the entry opening 3*c*, as illustrated. The angle α amounts to at least 10 degrees and lies preferably between 30 degrees and 150 degrees, in particular between 60 degrees and 120 degrees. The angle α is preferably never smaller than that angle at which a sliding of the solid material on the blade entry edge 2*a* or between the blade entry edge 2*a* and the guide vane edge 5*a* is no longer ensured.

Figure 3:
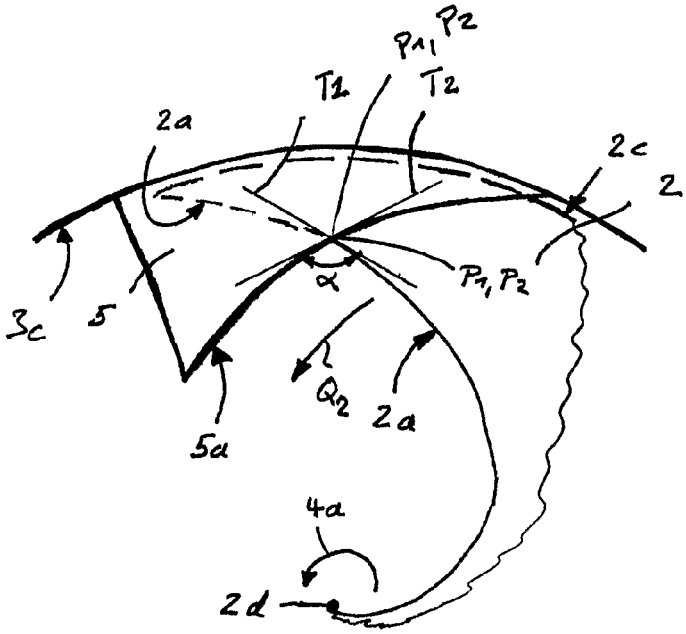
FIGS. 3 and 4 two different total angles of the blade entry edge and the guide vane edge.
Figure 4:
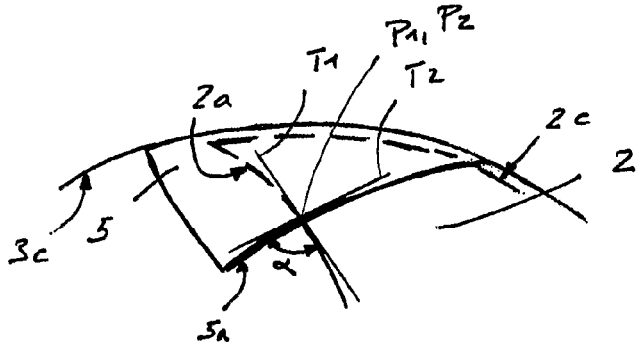

FIGS. 3 and 4 show in two detailed views, analogously to the illustration of FIG. 2, two differently extending three-dimensional curves, i.e. the blade entry edge 2*a* and the guide vane edge 5*a*, with the enclosed angle α of the tangents T1, T2 at the points P1, P2 in FIG. 3 amounting to approximately 110 degrees and in FIG. 4 to approximately 90 degrees. This angle α is determined by the course of the three-dimensional curves 2*a*, 5*a* and can thus be correspondingly selected in the design of the screw-centrifugal pump 1. The course of the three-dimensional curves 2*a*, 5*a* can be selected in such a way that the angle α remains substantially constant during the movement of the points P1, P2 in the direction Q2. Through correspondingly extending three-dimensional curves 2*a*, 5*a*, the angle α can also increase and/or decrease during the movement of the points P1, P2 in the direction Q2.

In an advantageous design at least one part of the blade edge section 2*b* and/or of the guide vane edge section 5*b* is formed as an edge, cutting edge or blade in order to weaken or to cut through solid material which is located between the sections 2*b*, 5*b*.

In general, the larger the angle α is selected to be, the more a solid material is pushed along the edge sections 2*b*, 5*b* or, respectively, the smaller the angle α is selected to be the more easily is a solid material parted by the edge sections 2*b*, 5*b*. In addition, through appropriate shaping, the length of the effective edge sections 2*b*, 5*b* can be determined. Thus the screw-centrifugal pump can be optimized in accordance with the solid materials and additions that are to be expected in such a way that the edge sections 2*b*, 5*b* and their angle α are selected in a correspondingly optimized manner in order to prevent a clogging up of the pump, and for example, to additionally achieve a good pumping efficiency.

Figure 5:
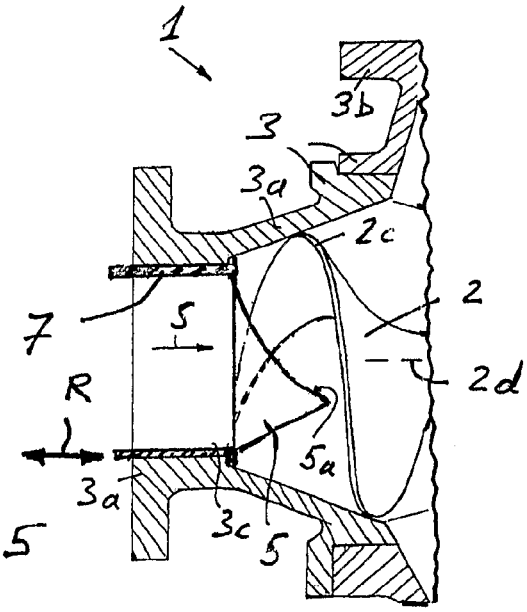
FIG. 5 displaceably arranged guide vane.

FIG. 5 shows a further embodiment of a screw-centrifugal pump 1 in the inlet opening 3*c* of which a wear-resistance sleeve 7 is disposed which is fixedly connected to the guide vane 5. The sleeve 7 can be firmly connected to the pump housing 3 by an attachment means which is not illustrated.

When the fastening means are released, the sleeve 7 and thus also the guide vane 5 is displaceable in the direction of movement R. This arrangement has, in particular, the advantage that the distance between the blade entry edge 2*a* and the guide vane edge 5*a* can be adjusted, in particular the spacings of the points P1, P2 in the direction R or Q1 respectively. The blade entry edge 2*a* and/or the guide vane edge 5*a* wear during the operation of the pump so that the distance of the points P1, P2 increases in operation in the course of time. The sleeve 7 thus enables the position of the guide vane 5 to be reset anew in the direction of displacement R or Q1 respectively after certain time intervals. The sleeve 7 can also be designed in such a way that it is also rotatable in the entry opening 3*c*, i.e. is rotatable with respect to the impeller axis 2*d*, in order to rotate the sleeve 7 in the released state and thus also to rotate the position of the guide vane 5.

The invention claimed is:

1. A screw-centrifugal pump, comprising:

a pump housing;

an inlet opening;

an impeller comprising a spirally extending blade entry edge that rotates about an axis of rotation in a direction for carrying material away from the inlet opening; and a guide vane comprising a guide vane edge, wherein the guide vane is disposed near the inlet opening and the guide vane edge, in the direction of rotation, increasingly projects in the direction of the axis of rotation of the impeller and into an interior space of the impeller.

2. A screw centrifugal pump in accordance with claim 1, wherein the guide vane is fixably mounted and wherein the fixed position of the guide vane is adjustable.

3. A screw-centrifugal pump in accordance with claim 1, wherein the guide vane edge includes a guide vain edge section and forms a fixed three-dimensional curve and the blade entry edge includes a blade edge section and forms a rotatable three-dimensional curve, wherein the fixed and rotatable three-dimensional curves extend in a mutually matched manner such that the guide vane edge and the blade entry edge have a mutual spacing or mutually touch one another, depending on the position of the impeller.

4. A screw-centrifugal pump in accordance with claim 3, comprising: a first point on the blade edge section; and a second point on the guide vane edge section, wherein the first point and the second point have the smallest mutual spacing between them of any two points on the first edge section and the guide vane edge section, respectively, and wherein rotating the impeller causes the first point and the second point to move along the axis of rotation in the same direction as fluids.

5. A screw-centrifugal pump in accordance with claim 4, wherein the blade edge section has a first tangent at the first point, the guide vane edge section has a second tangent at the second point and the first and second tangents form an intersection angle of at least 10 degrees in a plane perpendicular to the axis of rotation.

6. A screw-centrifugal pump in accordance with claim 5, wherein the intersection angle is between 30 degrees and 180 degrees.

7. A screw-centrifugal pump accordance with claim 3, wherein the blade edge section or the guide vane edge section formed at least partly as a cutting edge.

8. A screw-centrifugal pump in accordance with claim 1 wherein the guide vane is fixed to the inlet opening.

9. A method for the conveying of a liquid permeated with solid additions using a screw-centrifugal pump, comprising:

directing material from an inlet opening to an interior space of an impeller using a guide vane comprising a guide vane edge, wherein the guide vane is disposed near the inlet opening and, as the impeller rotates about an axis of rotation, the guide vane edge, in the direction of rotation, increasingly projects in the direction of the axis of rotation of the impeller and into an interior space of the impeller, so that the liquid is directed in such a way that at least some of the solid additions slide along a spirally extending blade entry edge of impeller, such that the solid additions are moved mechanically in a flow direction of the fluid by the impact of the blade entry edge.

10. A method in accordance with claim 9, wherein a guide vane edge of the guide vane and the blade entry edge mutually cooperate when the impeller is rotating such that the solid addition located between the blade entry edge and the guide vane edge is mechanically comminuted by the blade and vane edges or shifted in the directions that rotating the impeller causes materials to flow.

* * * * *